US005775619A

United States Patent [19]

Tabellini

[11] Patent Number: 5,775,619

[45] Date of Patent: Jul. 7, 1998

[54] ROLLER FOR WINDING AND UNWINDING A PROTECTIVE COVER EQUIPPING A MACHINE TOOL OR THE LIKE

[75] Inventor: Giorgio Tabellini, Sasso Marconi, Italy

[73] Assignee: P.E.I. Protezioni Elaborazioni Industriali S.R.L., Zola Predosa Bologna, Italy

[21] Appl. No.: 724,060

[22] Filed: Sep. 23, 1996

Related U.S. Application Data

[63] Continuation of Ser. No. 242,364, May 13, 1994, abandoned.

[30] Foreign Application Priority Data

Jun. 29, 1993 [IT] Italy ..... BO93A0300

[51] Int. Cl.[6] ..... B65H 75/48; A47G 5/02; A47H 1/00

[52] U.S. Cl. ..... 242/372; 254/364; 160/245; 185/39; 267/168

[58] Field of Search ..... 242/372, 226, 242/251, 351; 254/364; 160/245; 185/39; 267/168

[56] References Cited

U.S. PATENT DOCUMENTS

| | | | |
|---|---|---|---|
| 571,972 | 11/1896 | Janney | 267/168 X |
| 1,550,879 | 8/1925 | Clark | 160/245 X |
| 2,248,447 | 7/1941 | Wood | 267/168 |
| 2,942,409 | 6/1960 | Morf | 185/39 |
| 3,242,895 | 3/1966 | Hornby | 242/372 X |
| 3,292,684 | 12/1966 | Jines | 160/245 X |
| 4,576,762 | 3/1986 | Griffin et al. | 267/168 X |
| 5,201,897 | 4/1993 | Whiting | 267/168 X |

*Primary Examiner*—John Q. Nguyen

*Attorney, Agent, or Firm*—Nicholas A. Kees; Godfrey & Kahn, S.C.

[57] ABSTRACT

A roller comprises: a support shaft bearing at either opposite end a bush supporting an external tubular element containing the shaft and destined to be a support element of a cover fixed thereto by one end; a motor to recall the roller by setting the tubular element in rotation about the shaft in an opposite direction to that followed during an unwinding of the cover, and constituted by at least two helix springs, separate but cooperating, which are coaxially keyed on the shaft; the ends of each spring being stably fixed on corresponding seats exhibited by a first support keyed on the shaft and a second support, axially fixed and rotatably mounted on the shaft, and solid to the tubular element.

12 Claims, 4 Drawing Sheets

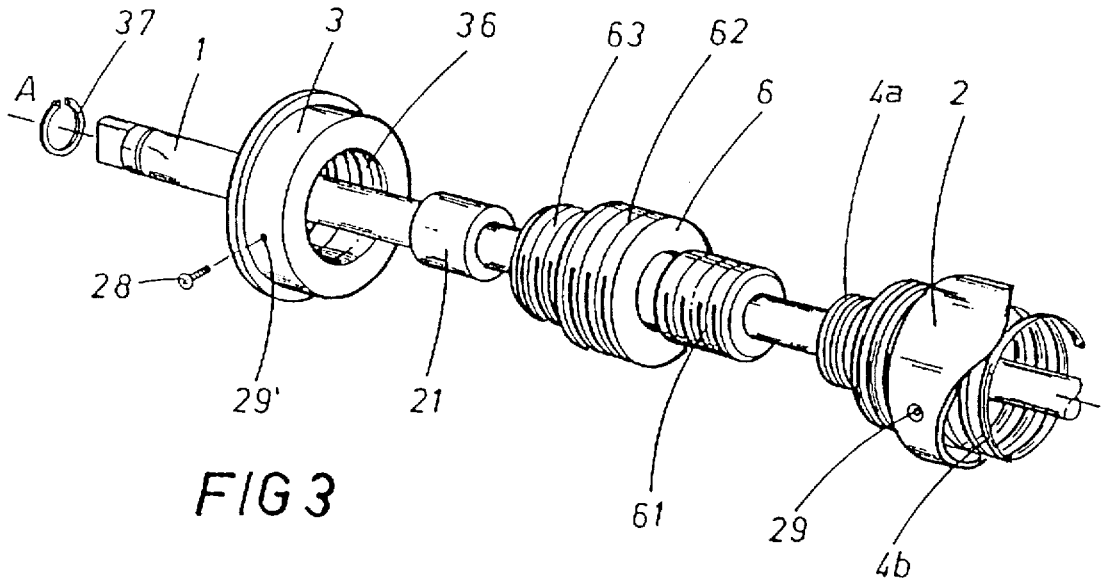
FIG 3
FIG 5
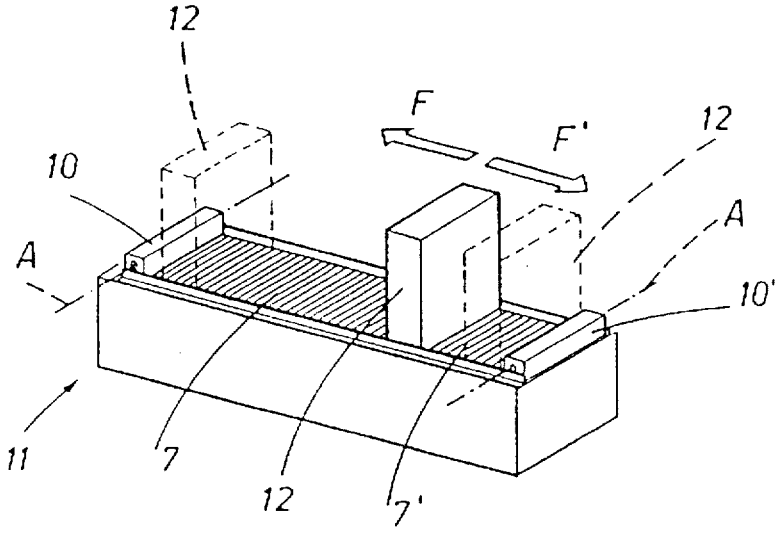

ROLLER FOR WINDING AND UNWINDING A PROTECTIVE COVER EQUIPPING A MACHINE TOOL OR THE LIKE

This application is a continuation of application Ser. No. 08/242,364 filed on May 13, 1994, abandoned.

BACKGROUND OF THE INVENTION

The invention relates to a winding roller, in particular for protective structures for machine tools or the like, and more precisely for protection structures such as tarpaulins, blinds, mats and the like, used to protect sliding guides or other parts of such machines, and serves as an alternative to other types of protective covering, such as bellows-type structures.

The structures in object usually develop along a single plane and slide along guides, and change conformation according to the positioning of the slides to which they are attached by one end. They pass, therefore, from a first position in which they are wound about the roller arranged perpendicularly to their winding direction, to a second position in which they are unwound from the roller in order to protect an area equal to the relative extension according to the conformation assumed. Their free end is fixed to a mobile part of the machine that slides along the guides to be protected, while the other end is wound about a roller.

The structure is unwound from the roller by traction created on moving the mobile parts, while its rewinding is commanded by motor organs of various types, acting directly on the roller and rotating it in an opposite direction to the unwinding direction. The invention relates to the field of spring-driven rollers.

The spring is usually a helix, coaxially keyed on a roller shaft and, like the shaft, is arranged perpendicular to the winding/unwinding direction of the protection structure, which will hereinafter be referred to as a cover.

The spring and the shaft are contained inside a cylinder, which is closed at each end by a bush rotatably keyed on the shaft.

The spring is fixed at one end to one of the bushes and at the other end to a support which is solid to the shaft.

The cover is rolled up on the external surface of the cylinder, which is induced to rotate as the cover is drawn by the sliding guides.

During the unwinding of the cover, the cylinder rotates about the shaft, thus torquing and loading the spring, which is associated at one end to one of the bushes and at another end is solid to the shaft at the keyed support. The spring increases by one spiral for every complete revolution it makes, and obviously its diameter is reduced at least in its active zone, as the bush and the support are kept at a fixed distance one from the other.

Once the slides have stopped drawing out the cover, the accumulated elastic energy in the spring solicits a return movement of the cover, so that when the slide guides are returned towards the roller, the cover will be rewound on the cylinder external surface.

Spring-loaded rollers, though simpler than other types of motor, have in the past presented limiting drawbacks. One of these is due to the fact that many protection covers are much longer than they are wide. For this reason, the length of the cylinder, more or less equal to the width of the cover, will only house a shortish spring, which cannot provide the necessary traction force or distribution for a long cover, nor an adequate number of spring revolutions to pay out all of the cover.

Short springs having a considerable wire diameter might be used for the above purpose, but apart from having a high elastic constant, such springs are composed of a small number of spirals, so that the spring load increases considerably with each turn of the cylinder.

It is well at this point to dwell on a technical detail which will help in our explanation of the present disclosure. During its rotation in the two above-described senses, the spring passes from being almost totally unloaded to being almost totally loaded ("almost" because it is practically impossible to reach the two extreme configurations). The antagonist force of the spring, then, grows as the cover is paid out from the cylinder, and its recall force increases correspondingly. If we suppose that a spring passing from the one of the two almost total situations to the other performs a number n of rotations, the force with which the spring recalls the cover will be greater when the spring has reached n rotations than when it has reached n/2 rotations. This fact derives from a law relating to constructional characteristics of the spring itself, such as elastic constant and length, which in turn depend on the materials used and the section of the spring wire. Thus we can say that a spring made with large-section wire passes from minimum value to maximum value after a relatively small number n of rotations, so that in order to potentialize it to perform a greater number of rotations it will have to be lengthened axially to increase its number of coils.

With such a spring it is difficult to obtain a constant elastic reaction from the beginning to the end of the winding. Thus both the set, that is a spring "give" under the action of a force in the direction of the force itself, and the deformation is proportional to the number of spring coils.

It is evident, then, that the use of springs having large-diameter wire, or springs which are axially short, leads to utilizing them at the limits of their deformability, which might result in their permanent deformation. It is well to remember that such types of spring, when used as recall springs, work very well when the coils are kept very close to each other.

Apart from this, the use of a single spring made with large-diameter and short wire, thus obtaining a good elastic constant, implies a need to exploit to the full the dynamic properties of the spring, in the sense that a number of rotations n corresponding to a spring total extension also corresponds to a maximum possible number of rotations.

The result is an elastic reaction force distribution which is divided into an interval of rotations wherein the difference in the force obtainable between the start and the end of the reaction force distribution is considerable and does not allow of a constant distribution throughout the cover winding-in operation. This drawback is particularly relevant in relation to some machines, for example measuring machines, where a much-differentiated force between beginning and end of winding might damage the functionality of the machine being covered, since the cover will interact with the uprights of the machine, which uprights are highly sensitive to inconstant variations in force.

The aim of the present invention is to obviate the above-described drawbacks.

BRIEF SUMMARY OF THE INVENTION

The invention solves the set problem by providing a winding roller, in particular for windable protection structures for machine tools or the like, comprising a shaft bearing at either opposite end a bush supporting an external tubular element containing the shaft and destined to be a support element of the cover fixed thereto by one end; a motor to recall the roller by setting the tubular element in rotation about the shaft in an opposite direction to that followed during an unwinding of the cover, and constituted by a helix spring keyed on the shaft and fixed at one end to a first support keyed on the shaft, and with another end fixed to a second rotatably mounted support, without axial sliding capability on the shaft and solid to the tubular element, such that when the roller rotates in a direction corresponding to an unwinding of the cover, the helix spring is loaded about the shaft, wherein the motor comprises at least two helix springs, separate but cooperating, which are coaxially keyed on the shaft; the ends of each spring being stably fixed on corresponding seats exhibited by the first and second supports.

By equipping the roller with more than one spring, smaller-section spring wires can be used to obtain similar dynamic effects; that is, a same recall force once the spring has been loaded by causing it to rotate about its own axis and holding one end of it still while rotating another end. The at least two springs together equal a force possible with one spring, but are made with a smaller-diameter wire, so that each spring has more coils. Logically, therefore, an elastic reaction of each spring corresponds to accumulated energy according to a number of rotations it performs during its rotations, and will be less than a reaction force of one larger-diameter spring; but as there are two springs, and the forces are summed together, the recall force will be equal.

Having more coils, the smaller-diameter spring will complete a greater number of rotations n in going from its unloaded configuration to a fully-loaded configuration: consequently, since the roller must perform a constant number of rotations fully to call in a same cover, when smaller-diameter springs are used for recalling the cover, less energy will be available for recall, but since more than one spring is used, the sum of forces of the smaller-diameter springs will be equal to the force of one large-diameter spring. The true advantage of the solution disclosed herein relates to the way in which the energy accumulated is expended by two such springs rather than one of a larger-diameter wire type. Two equal and coaxial springs will not have reached a situation of almost complete load, so that the accumulated energy gradient will be less and resultingly the recall force will be more linear and less brusque: the final recall effect, though, will be equally as good as that of one larger-diameter spring.

It follows that the use of more than one such spring reduces the number of rotations that each spring is required to make, and accordingly the length (and number of coils) of said springs can be reduced, with a consequent reduction in the mass of the roller.

The elastic reaction of the springs is advantageously very linear, so that they can be provided also where narrow covers are used, and also in machines where constant use is made of the winding force of the cover, such as for example in measuring machines.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which:

FIG. 3 is a perspective exploded view of some component parts of the invention;

FIG. 5 is a perspective view from above of an example in use of a roller made according to the present invention.

DESCRIPTION OF THE PREFERRED EMBODIMENTS

FIG. 5 shows a typical situation in which the cover of the invention might be applied. A machine 11, schematically represented and not specifically identified since to do so would be unnecessary to the present description, is equipped with a mobile part 12 that slides to and from in the direction indicated by F-F' along straight guides, and therefore occupies various transversal positions (indicated by broken lines). The guides along which the mobile part 12 slides are protected by two like covers 7 and 7', attached at one end to the mobile part 12 and at their other ends to winding rollers 10 and 10', so that when the mobile part 12 is moving, one cover is always rewinding while the other is always unwinding. Obviously the aforegoing is intended solely as an example of a possible use of the invention, not to the exclusion of other uses.

Figure 1:
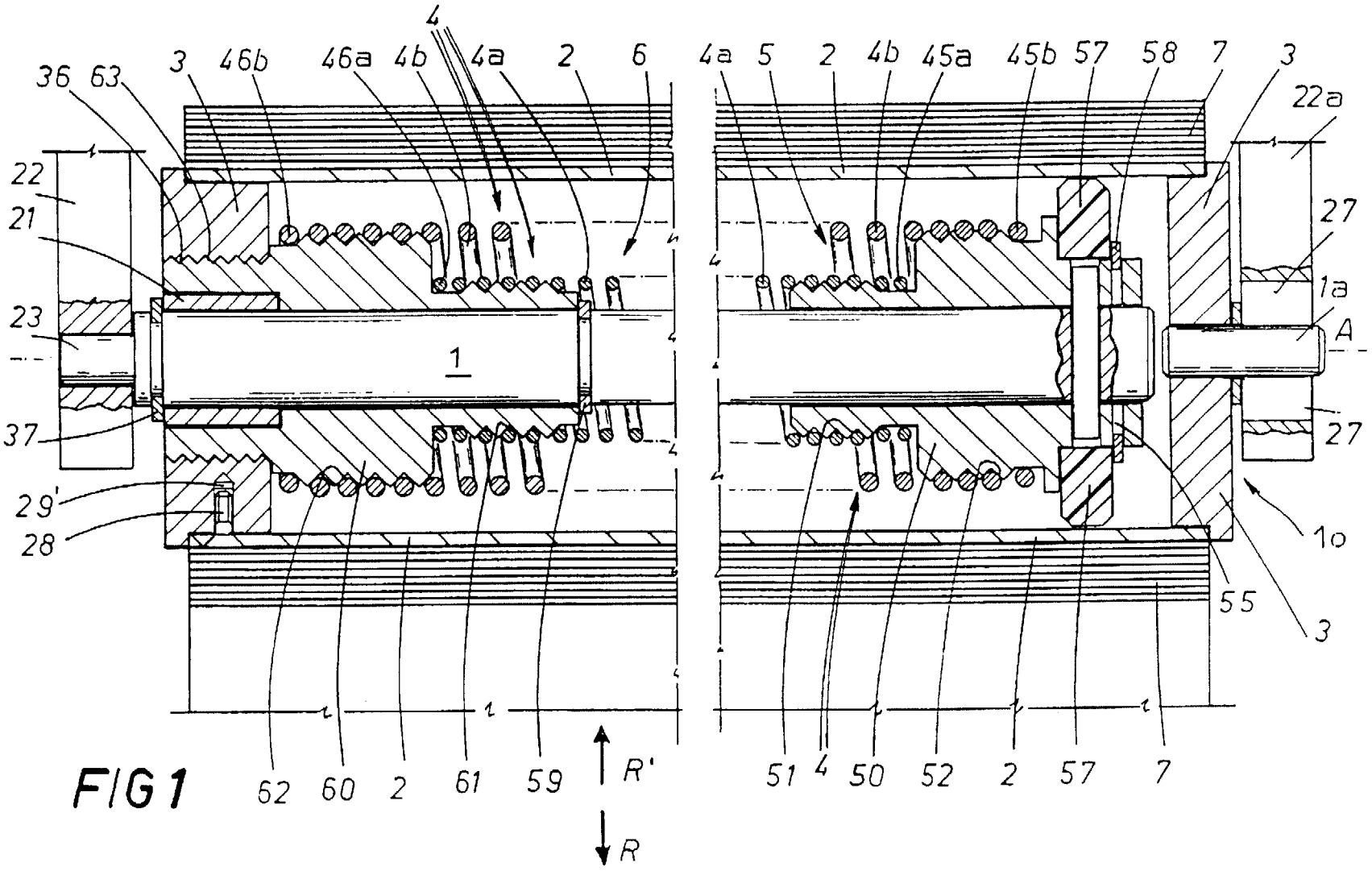
FIG. 1 is a lateral view, with some parts removed better to evidence others, of an embodiment of the present invention.

With reference to FIG. 1, a roller 10 is supported by a shaft 1 defining a rotation axis A. A tubular element 2 is keyed on the shaft 1, and an end of a cover 7 is attached in a known way (not illustrated) to said tubular element 2: the cover 7 then can be wound on and off the tubular element 2 by a motor, which will be described hereinbelow, in directions R and R'.

Bushes 3, having a same transversal section as the tubular element 2, are associated to opposite ends of the tubular element 2 and exhibit through-holes constituting seats for a rotatable association of the tubular element 2 with the shaft 1.

Figure 2:
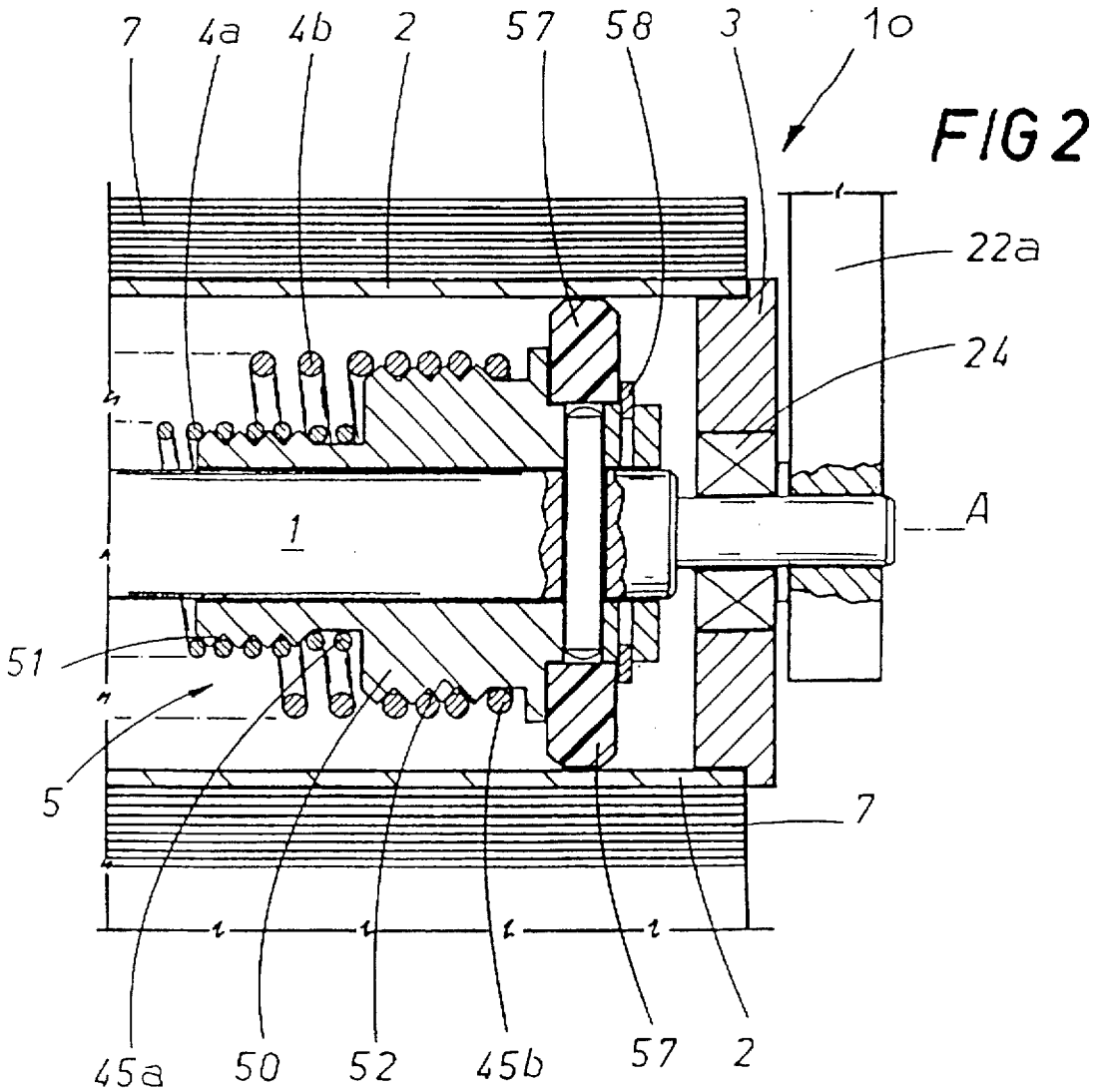
FIG. 2 is a lateral partial view, with some parts removed better to evidence others, of a detail relating to an embodiment of the invention.
Figure 4:
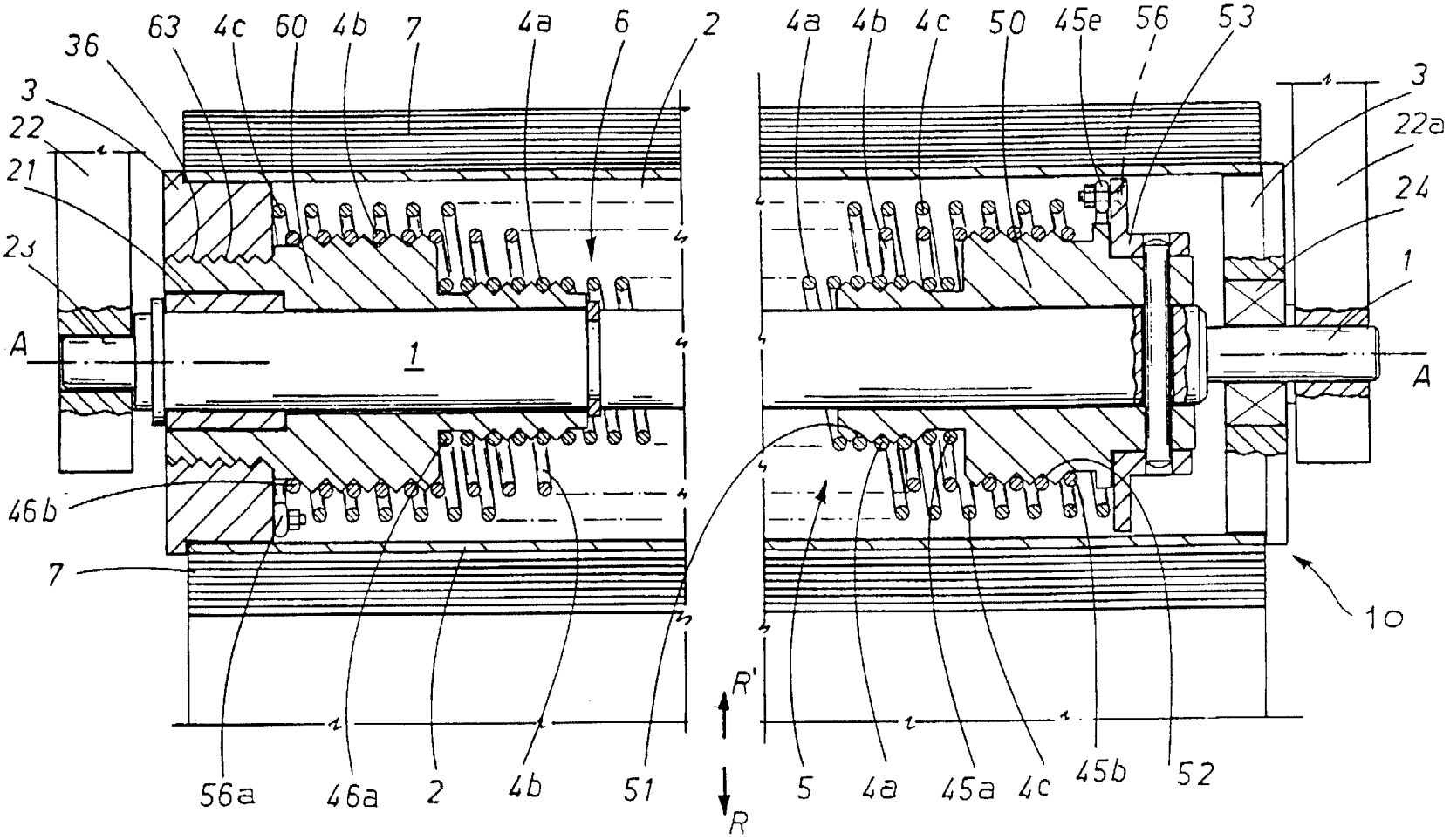
FIG. 4 is a frontal view with with some parts removed better to evidence others of a detail relating to a further embodiment of the invention.

The shaft 1 can be fixed on a support structure 22 constituted, for example, by parts of the machine whereon the cover 7 is mounted either at one end only at one of its ends 23, as shown in FIG. 1, or at both ends, thus completely crossing the support structure 22 longitudinally, such as in FIGS. 2 and 4.

The connection between the shaft 1 and the support structure 22 is however such as to enable the support structure 22 to rotate on the shaft 1. Brass bearings 21 or the like, as illustrated in FIG. 1, can be provided to interact between the shaft 1, which is stably fixed in a first portion 22 of a machine, and one of the bushes 3, with the other bush 3 being fixed on a second shaft 1*a*, arranged along the same axis A as the first shaft 1 and rotatably constrained to it by a bearing 27 on a corresponding portion 22*a* of the machine facing the first portion 22.

In a further embodiment, partially illustrated in FIG. 2 and fully illustrated in FIG. 4, the shaft 1 extends over a greater length than that covered by the tubular element 2, such as to be fixed at both portions 22 and 22*a* of the support structure 22 of the machine, with bearing connections 21 and 24 interacting at the two ends of the tubular element 2 between the shaft 1 and the bushes 3.

A motor 4 is provided for winding and unwinding the cover 7 off and on to the tubular element 2, comprising at least two cylindrical helix springs 4*a* and 4*b*, keyed on the shaft 1 internally of the tubular element 2.

To connect, at least kinematically, the springs 4*a* and 4*b* to the roller, two supports are provided: a first support 5, on the right in FIG. 1, keyed fixedly on the shaft 1, and a second support 6, rotatably keyed on the shaft 1 and solid in rotation with the tubular element 2.

Axial translation blocking means are also provided, at least in terms of a nearing translation, of the first and the second supports 5 and 6. In FIG. 1 the fixing of the second support 6 is realised by a blocking ring 59 radially arranged on the shaft 1 such as to distance the supports 5 and 6 during the rotation of the tubular element 2 corresponding to the unwinding of the cover 7.

A fixing ring 37 is also provided (see FIGS. 1 and 3) for blocking outward sliding of the bush 3 with respect to the shaft 1.

In this way the springs 4*a* and 4*b* are loaded by exploiting the revolutions of the tubular element 2 about axis A, a load which will thereafter be unloaded in a contrary direction, causing the cover 7 to rewind around the tubular element 2. The springs 4*a* and 4*b* can be more than two in number, but must cooperate as they are associated to supports 5 and 6, notwithstanding the fact that they do not contact one another. For this reason the first support 5 is constituted by a first body 50 developing on at least two cylindrical surfaces coaxial to the shaft 1, each being equipped with threads 51, 52 provided with equal-sized and equally-directed grooves to those of the coils of the corresponding ends 45*a* and 45*b* of the springs 4*a* and 4*b*.

The threads and the coils of the springs 4*a* and 4*b* constitute a stable mechanical connection, constrained by screwing between the first support 5 and the ends 45*a*, 45*b* of the springs fixed to said first support 5.

In a like way, the second support 6 is constituted by a second body 60, developing on at least two cylindrical surfaces coaxial to the shaft 1 and each provided with a thread 61, 62 with equal-sized and equally-directed grooves to those of the coils of the corresponding ends 46*a* and 46*b* of the springs 4*a* and 4*b*. Also in this latter case the threads and the coils of the springs 4*a* and 4*b* constitute a stable mechanical connection, constrained by screwing between the second support 5 and the ends 46*a*, 46*b* of the springs fixed to said second support 5.

When a greater number of springs is to be used, the first 5 and the second 6 supports (only the first is shown in FIG. 4) can be provided with connecting elements 53, which in the example shown are discoid, for connecting up to other springs, which in the fiure are schematized by including a third spring 4*c*, but which could be even more than three in number.

The connecting elements 53 extend radially with respect to the shaft 1 and are provided with seats 56 for stably inserting screws interacting between the connecting elements 53 and the ends 45*c*, 46*c*, of the specially-shaped springs.

FIGS. 1, 3 and 4 show how the second support 6 and one of the bushes 3 are complemntarily threaded with threads 36 and 63, aimed at constraining the tubular element 2 to the second support 6, associated to the bush 3 by a screw 28 passing between the seat 29 provided on the tubular element 2 and inserted in the seat 29' provided on the bush 3.

In the embodiment of FIG. 1, the first support 5 is provided with a spacer 57, fixed to the shaft 1 by a sealing ring 59. The spacer 57 radially extends about the body 50 and is provided with an external surface which faces and contacts (with a low friction coefficient) the internal surface of the tubular element 2, so that should there be contact due to play between the shaft 1 and the tubular element 2, the rotation freedom of the tubular element 2 with respect to the shaft 1 would not be compromised.

The first and the second supports 5 and 6 can be made in various ways, but once mounted the first 5 will be keyed on the shaft 1 and the second will be rotatable about the same shaft 1, and the axial distance of the one from the other along the shaft 1 will remain fixed.

Possible alternative embodiments of the supports might envisage, for example, two equal supports each provided with two concentric cylindrical threaded surfaces destined to be associated with corresponding spring ends. The two supports made in this way would be mounted symmetrically arranged one to the other along the shaft 1, with the cylindrical surfaces of a smaller diameter being arranged more internally with respect to the bushes, than those of greater diameter. Externally, on the side facing the bushes 3, the supports exhibit special means for associating respectively the first support 5 by keying on the shaft 1 and the second support 6 by fixing to the bush 3 arranged by its side. The means for associating can be, for example, pivots or connecting rods radially arranged with respect to the shaft 1.

In other embodiments, illustrated in FIG. 1, the supports can be differently conformed. The first 5 can exhibit, in addition to the said cylindrical surfaces destined to the springs 4*a* and 4*b*, a third cylindrical surface provided with a throat 55 destined for a sealing ring 58 or a functionally similar organ permitting stable association to the shaft 1. The second 6, apart from the said two surfaces with the threads 61 and 62, exhibits a third surface, from the external side with respect to the shaft 1, provided by the said thread 63, screwable on the corresponding bush 3. The threads 61 and 62, as illustrated in FIG. 3, are complementary with regard to screwing direction, number of coils of the springs 4*a* and 4*b*, while the threads 36 and 63 are associable according to an opposite direction to that followed by threads 61 and 62 when screwing with the springs 4*a* and 4*b*.

A still further embodiment of the supports is illustrated in FIG. 4 and has already been described, destined to equip rollers with at least three springs, 4*a*, 4*b* and 4*c*. In this case the first support 5 is provided with a discoid connecting element 53 for one end 45*c* of a third spring 4*c*.

This connecting element 53 extends radially with respect to the shaft 1 and is equipped with a seat 56 for stably inserting a screw which interacts between the connecting element 53 and the end 45*c* of the spring 4*c*, ring-shaped to interact with the screw head.

The other end 46*c* of the spring 4*c* is fixed, in the embodiment shown in FIG. 4, directly on the bush 3 associated to the second support 6, in a seat 56*a*, similarly to the arrangement at the other end 45*c*. Obviously, a connecting element can also be provided for the second support 6, associable to the support 6 alone and not the bush 3.

On a same shaft 1, by varying the type of supports used and the dimensions of the 2 and therefore the bushes 3, it is possible to mount a variable number of springs, according to the functions of the machine the cover is mounted on, while at the same time limiting the longitudinal mass of the winding roller.

What is claimed:

1. A machine comprising:

a set of guides;

a mobile part movable along said guides, a flexible retractable cover, positioned over said guides;

an external tubular element, supported by rotary bearings, and coaxially containing a shaft having first and second opposed ends, with the bearings situated at the opposed ends of the shaft, the tubular element being rotatable with respect to the shaft by virtue of being supported by the rotary bearings;

means for preventing any substantial axial sliding between the tubular element and the shaft;

said cover being fixed at one end to the tubular element and at the other end to the mobile part of the machine;

a motor for axially rotating the tubular element in one direction after said tubular element has been axially rotated in the opposite direction;

a first support, fixedly constrained on the shaft, the first support being provided with at least first and second seats;

a second support, fixedly constrained to the tubular element and rotatably mounted on the shaft, the second support being provided with at least first and second seats;

wherein the motor comprises at least first and second nested helical torsion springs, separate but cooperating, which are coaxially mounted on the shaft, each of said springs having an axial length and a circumference, each of said springs having first and second ends, the first end of each of the at least first and second helical springs being respectively fixed in the at least first and second seats on the first support, the second end of each of the at least first and second helical springs being respectively fixed in the at least first and second seats on the second support, each of said springs having a plurality of coils spaced and dimensioned for multiple rotations of said springs, each of said springs having a wire diameter which is small compared to said axial length and said circumference of said springs.

2. A machine as recited in claim 1 wherein the first support and the second support each comprise a member having at least first and second cylindrical surfaces which are coaxial to the shaft, each of the at least first and second cylindrical surfaces being provided with a thread to which are screwed the coils at respective corresponding ends of the at least first and second springs, said threads and said coils together providing mechanical fixity between said supports and said springs.

3. A machine as recited in claim 2 wherein the second support has at least a third cylindrical surface provided with a thread for fastening said second support to said tubular element.

4. A machine as recited in claim 3 wherein:

the thread of the third cylindrical surface and the thread of the bearing have a first rotational sense, and the threads of the first and second cylindrical surfaces of the first support and the coils of the corresponding first and second springs have a second rotational sense, said second rotational sense being opposite to said first rotational sense.

5. A machine as recited in claim 1 further comprising:

a third spring, all of said springs having ends;

connecting elements for connecting the first support and the second support with the ends of said third spring, said connecting elements extending radially with respect to the shaft, each of said connecting elements including at least one seat; and means for fixing said connecting elements to said ends of said third spring;

said seats being dimensioned to permit stable insertion of said means for fixing said connecting elements to said ends of said third spring.

6. A machine as recited in claim 1, wherein:

the shaft has a center;

the at least first and second helical springs are coaxially keyed on the shaft in an order starting from the center of the shaft to the ends of the shaft; and said springs are constructed of wire having a wire diameter, said wire diameter varying from spring to spring, said order in which said springs are keyed on said shaft corresponding to an increase in spring wire diameter relative to a previous spring in said order.

7. A cover for covering guides along which a mobile part of a machine moves back and forth between two extreme ends, said cover comprising:

a pair of flexible retractable covering parts, each positioned over said guides at a respective side of said mobile part of said machine, each said cover being fixed at a first end to the mobile part of the machine, and at the other end to one of a pair of retracting means for retracting the covering parts, such that whenever the mobile part of the machine is moving, one covering part is being retracted while the opposite covering part is being extended, each of said retracting means comprising:

a support shaft having first and second opposed ends;

two rotary bearings situated at the opposed ends of the shaft;

an external tubular element, supported by the rotary bearings, and coaxially containing the shaft, the tubular element being rotatable with respect to the shaft by virtue of being supported by the rotary bearings;

said other end of said covering part being fixed to the tubular element;

means for preventing any substantial axial sliding between the tubular element and the shaft;

means for axially retracting the covering parts after the covering parts have been extended by movement of the mobile part of the machine as the mobile part moves toward the respective end of the guides;

a first support, fixedly constrained on the shaft, the first support being provided with at least first and second seats;

a second support, fixedly constrained to the tubular element and rotatably mounted on the shaft, the second support being provided with at least first and second seats;

wherein the axial retracting means comprises at least first and second nested helical torsion springs, separate but cooperating, which are coaxially mounted on the shaft, each of said springs having an axial length and a circumference, each of said springs having first and second ends, the first end of each of the at least first and second helical springs being respectively fixed in the at least first and second seats on the first support, the second end of each of the at least first and second helical springs being respectively fixed in the at least first and second seats on the second support, each of said springs having a plurality of coils spaced and dimensioned for multiple rotations of said springs, each of said springs having a wire diameter which is small compared to said axial length and said circumference of said springs.

8. A cover as recited in claim 7 wherein the first support and the second support each comprise a member having at least first and second cylindrical surfaces which are coaxial to the shaft, each of the at least first and second cylindrical surfaces being provided with a thread to which are screwed the coils at respective corresponding ends of the at least first and second springs, said threads and said coils together providing mechanical fixity between said supports and said springs.

9. A cover as recited in claim 8 wherein the second support has at least a third cylindrical surface provided with a thread for fastening said second support to said tubular element.

10. A cover as recited in claim 9 wherein:

the thread of the third cylindrical surface and the thread of the bearing have a first rotational sense, and the threads of the first and second cylindrical surfaces of the first support and the coils of the corresponding first and second springs have a second rotational sense, said second rotational sense being opposite to said first rotational sense.

11. A cover as recited in claim 7 wherein said retracting means further comprises:

a third spring, all of said springs having ends;

connecting elements for connecting the first support and the second support with the ends of said third spring, said connecting elements extending radially with respect to the shaft, each of said connecting elements including at least one seat; and means for fixing said connecting elements to said ends of said third spring;

said seats being dimensioned to permit stable insertion of said means for fixing said connecting elements to said ends of said third spring.

12. A cover as recited in claim 7, wherein:

the shaft has a center;

the at least first and second helical springs are coaxially keyed on the shaft in an order starting from the center of the shaft to the ends of the shaft; and said springs are constructed of wire having a wire diameter, said wire diameter varying from spring to spring, said order in which said springs are keyed on said shaft corresponding to an increase in spring wire diameter relative to a previous spring in said order.

* * * * *